United States Patent [19]

Lew

[11] Patent Number: 4,809,760

[45] Date of Patent: Mar. 7, 1989

[54] SELF-COILING PARTITION

[76] Inventor: Hyok S. Lew, 7890 Oak St., Arvada, Colo. 80005

[21] Appl. No.: 323,063

[22] Filed: Nov. 19, 1981

Related U.S. Application Data

[63] Continuation-in-part of Ser. No. 20,495, Mar. 14, 1979, Pat. No. 4,433,711.

[51] Int. Cl.[4] ..... E06B 9/08

[52] U.S. Cl. ..... 160/120; 160/238

[58] Field of Search ..... 160/120–122, 160/238, 241

[56] References Cited

U.S. PATENT DOCUMENTS

| | | | |
|---|---|---|---|
| 669,321 | 3/1901 | Holwager et al. | 160/121 |
| 1,469,150 | 9/1923 | Church | 160/121 C |
| 2,943,965 | 7/1960 | Stogre | 160/238 |
| 3,195,616 | 7/1965 | Taber | 160/238 |
| 3,306,344 | 2/1967 | Youngs | 160/241 |
| 4,433,711 | 2/1984 | Lew | 160/120 |

FOREIGN PATENT DOCUMENTS

| | | | |
|---|---|---|---|
| 2260348 | 6/1974 | Fed. Rep. of Germany | 160/122 |

*Primary Examiner*—Ramon S. Britts
*Assistant Examiner*—David M. Purol

[57] ABSTRACT

This invention relates to a partition such as a curtain, blind, shade etc. employing the self-coiling sheets which play the dual role of the partitioning medium as well as the mechanism providing the means for extending and retracting said partition. Said self-coiling sheets constituting the self-coiling partition may be a planar plastic sheet of a single or multiple layers in structure with an intrinsic material property of coiling itself into a roll, or a fabric reinforced with a plurality of the spiral springs providing the self-coiling characteristics, or a double layer of plastic sheet including a thin flat sheet under a tension suprimposedly bonded to a corrugated plastic sheet with a stiffness under compression whereby the combination of the tension and the compression provides the coiling moments distributed over said plastic sheet or double layer structure.

1 Claim, 1 Drawing Sheet

SELF-COILING PARTITION

This patent application is a continuation-in-part application to a patent application Ser. No. 020,495 entitled "Coil Curtain" filed on Mar. 14, 1979, which is now U.S. Pat. No. 4,433,711.

The demand for the energy efficient curtain arising from the high price of the gas and fuel caused by the dwindling energy resources is one reason to provide a new curtain or other means for partitioning the living space. Another reason for providing a new curtain is the availability of the plastic technology that enables to design and manufacture a totally unorthodox curtains or other means of partitioning.

The primary object of the present invention is to provide a self-coiling curtain or blind or shade or other means of partitioning wherein the means for extending and retracting said partitioning means is inherently included in the planar material comprising the partitioning means.

Another object of the present invention is to provide a partitioning means comprising one or more self-coiling sheets those coil themselves into one or more rolls when the external restrain is absent.

A further object of the present invention is to provide an inexpensive and light weight partitioning means.

Still another object of the present invention is to provide a partitioning means possessing a good deal of stiffness in spite of the construction using the flexible elements as the component.

Still a further object of the present invention is to provide a partitioning means having an attractive appearance.

These and other objects of the present invention will become clear as the description thereof proceeds. The present invention may be described with a great clarity and specificity by referring to the following figures.

Figure 1:
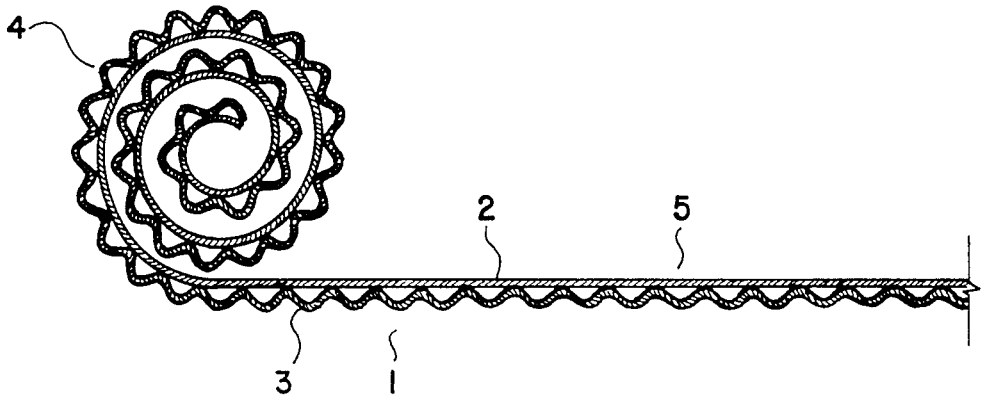
FIG. 1 illustrates a cross section of a self-coiling corrugated sheet that may be employed to construct a self-coiling partition.

In FIG. 1 there is shown a cross section of a self-coiling sheet of the corrugated structure, which cross section is taken along a plane perpendicular to the axis of the coiling of the self-coiling sheet. The corrugated coiling sheet 1 is construction of a thin flat sheet 2 under tension and a corrugated sheet 3 with a stiffness under compression wherein two sheets are bonded or glued to one another at every ridge of the corrugation. The parallel superposition of two layers in a tension and a compression respectively creates a coiling moment disturbed over the corrugated self-coiling sheet 1 and, consequently, the corrugated self-coiling sheet 1 coils itself into a roll 4 when the external restraint is absent, while it becomes stretched to a flat corrugated sheet when an external tension is exerted on one extremity of said corrugated self-coiling sheet as shown by the flat portion 5 in the figure. The corrugated structure serves another purpose in providing a stiffness along the direction in which the ridges and grooves of the corrugation are formed. A further purpose served by the corrugated structure is the diffusion of the sun light entering through the window in creating a more desirable lighting mode. "The double layer comprising a flat sheet and a corrugated sheet superimposed to one another works excellently in diffusing the sunlight passing through the double layer, as nonparallel layers in the double layer create a complex deflection-reflection-deflection pattern on the sunlight passing through."

The corrugated structure is also useful in checking the heat flow across the partition when it is used as a curtain or blind in the form of the self-coiling curtain.

Figure 2:
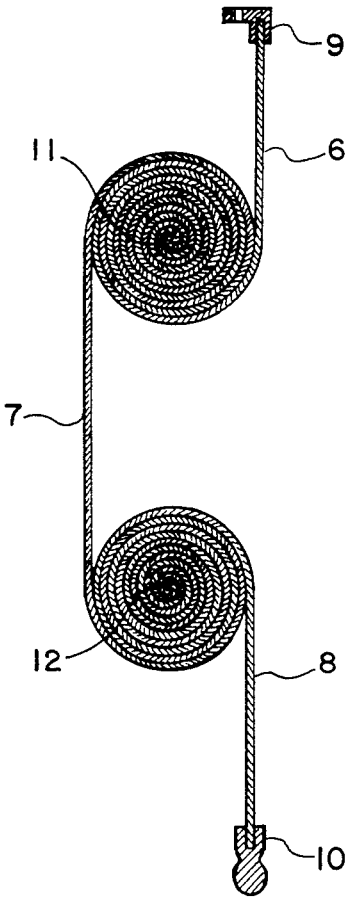
FIG. 2 illustrates a cross section of a self-coiling partition including a plurality of the self-coiling sheets.

In FIG. 2 there is shown a cross section of a self-coiling partition constructed in accordance with the principles of the present invention, which cross section is taken along a plane perpendicular to the axis of the coiling. A first self-coiling sheet 6 has one end anchored to an anchoring means 9 that can be connected to the window frame or other frame of the dwelling. The other end of the self coiling sheet 6 is spliced to one end of the second coiling sheet 7 in such a way that both self coiling sheets 6 and 7 coil itself into a common roll which roll starts from the line of the splice 11. The other end of the coiling sheet 7 is spliced to one end of the third self-coiling sheet 8 wherein both self-coiling sheets 7 and 8 coil themselves into a common roll which roll starts from the line of splice 12. The other end of the self-coiling sheet 8 is anchored to a handled means 10 which includes a stop means such as a magnet, suction cup, friction foot, grabbing foot etc, in order to stop the self-coiling partition at the fully or partially extended positions against the self-coiling force of the self-coiling partition. The self-coiling sheets 6, 7, 8 etc. may be of the construction of the self-coiling corrugated structure as shown in FIG. 1 or a plastic or matalic sheets with an intrinsic coiling force or a fabric reinforced with a plurality of the spiral springs providing the self-coiling characteristics. It should be understood that the embodiment of the self coiling partition illustrated in FIG. 2 may include any number of the self-coiling sheets to suit the specific requirement. It is not difficult to realize that the residual rolls remaining after the self-coiling partition is extended, act like the stiffeners keeping the partition flat and straight. The multiple number of the rolls in the self-coiling partition helps to keep the diameter of the individual roll reasonably small even when a thick self-coiling sheet such as the corrugated self-coiling sheet as shown in FIG. 1 is employed in constructing said self-coiling partition.

Figure 3:
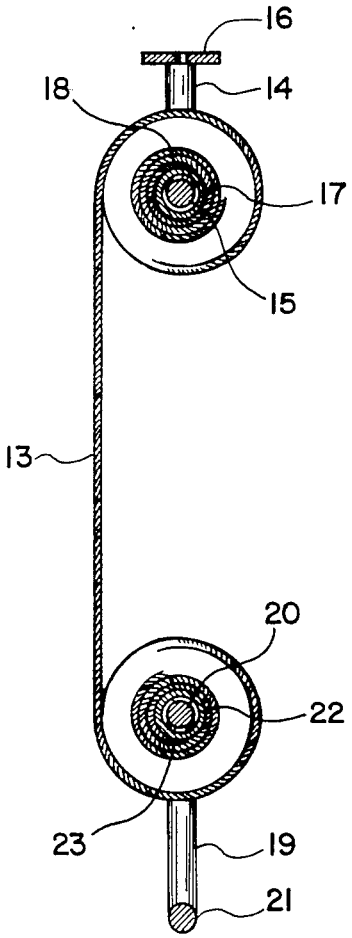
FIG. 3 illustrates another embodiment for a self-coiling partition.

In FIG. 3 there is shown another embodiment for the self-coiling partition, which is shown in a cross section taken along a plane perpendicular to the axis of the coiling. The self-coiling sheet 13 coils itself into two rolls. One end 18 is anchored to the first cylindrical bearing 17 which is rotatably disposed about a shaft 15. The combination of the cylindrical bearing 17 and the shaft 15 may be of a stub construction disposed on each end of the roll of said self-coiling sheet or of the elongated structure extending through the roll of said self-coiling sheet or of a combination of the stub shaft with the elongated cylindrical bearing. The shaft 15 is supported by a member 14 extending from a mounting means 16 that can be fastened to the window frame or other structures in the dwelling. The other end 23 of the self-coiling sheet 13 is anchored to the second cylindrical bearing rotatably engaging the shaft 20, which shaft is supported by a member 19 extending from the handle means 21. The combination of the cylindrical bearing 22 and the shaft 20 may be of the stub construction or the elongated structure or in between thereof as described previously. The handle means 21 may include a stop means that prevent the self-coiling partition from coiling itself. It should be understood that a further embodiment for a self-coiling partition may be obtained by combining those embodiments shown in FIGS. 2 and 3. More specifically, one may employ the construction using the structure for two end most rolls as shown in FIG. 3 while using the rolls around the line of splice as shown in FIG. 2 in constructing a third embodiment of the self-coiling partition wherein a plurality of the self-coiling sheets are employed.

While the principles of the present invention have now been made clear by the illustrative embodiments, there will be immediately obvious to those skilled in the art many modifications of the structure, elements, proportion and arrangement particularly adapted to the specific working environment and operating condition without departing from those principles of the present invention.

I claim:

1. The self-coiling sheet of a corrugated structure comprising a thin flat sheet under tension and a thin corrugated sheet with a stiffness under a compression, said thin corrugated sheet superimposedly bonded to said thin flat sheet; whereby, the tension in said thin flat sheet and the compression in said thin corrugated sheet acting on two parallel planes create a coiling moment distributed over said self-coiling sheet of a corrugated structure.

* * * * *